US007552833B2

(12) United States Patent
Tsutsui et al.

(10) Patent No.: US 7,552,833 B2
(45) Date of Patent: Jun. 30, 2009

(54) SYNTHETIC RESIN CONTAINER HAVING IMPROVED SHAPE STABILITY

(75) Inventors: Naoki Tsutsui, Tokyo (JP); Shoji Tanabe, Tokyo (JP); Hiromichi Saito, Tokyo (JP)

(73) Assignee: Yoshino Kogyosha Co., Ltd., Tokyo (JP)

( * ) Notice: Subject to any disclaimer, the term of this patent is extended or adjusted under 35 U.S.C. 154(b) by 740 days.

(21) Appl. No.: 10/490,258

(22) PCT Filed: Sep. 26, 2002

(86) PCT No.: PCT/JP02/09976

§ 371 (c)(1),
(2), (4) Date: Oct. 29, 2004

(87) PCT Pub. No.: WO03/029087

PCT Pub. Date: Apr. 10, 2003

(65) Prior Publication Data

US 2005/0045645 A1 Mar. 3, 2005

(30) Foreign Application Priority Data

Sep. 27, 2001 (JP) ..... 2001-295405
Sep. 27, 2001 (JP) ..... 2001-295930
Sep. 27, 2001 (JP) ..... 2001-297405

(51) Int. Cl.
*B65D 1/02* (2006.01)
*B65D 1/46* (2006.01)

(52) U.S. Cl. ..... 215/381; 215/382; 220/669; 220/675

(58) Field of Classification Search ..... 215/381, 215/383, 382, 384; 220/671, 572, 771, 675, 220/666, 669
See application file for complete search history.

(56) References Cited

U.S. PATENT DOCUMENTS 5,199,588 A * 4/1993 Hayashi ..... 215/381
5,238,129 A * 8/1993 Ota ..... 215/381
5,381,910 A * 1/1995 Sugiura et al. ..... 215/398
5,499,730 A * 3/1996 Harbour ..... 215/382
5,746,339 A * 5/1998 Petre et al. ..... 215/383
6,213,326 B1 * 4/2001 Denner et al. ..... 215/383

(Continued)

FOREIGN PATENT DOCUMENTS

GB 2025889 A * 1/1980

(Continued)

*Primary Examiner*—Su A Weaver
(74) *Attorney, Agent, or Firm*—Oliff & Berridge, PLC

(57) ABSTRACT

The synthetic resin container according to the present invention has a waist dividing a container main body portion into upper and lower parts, wherein the waist is formed on an annular groove surrounding the main body portion to as to be convex toward the interior of the container. The annular groove has reinforcing ribs with a level higher than a groove bottom of the annular groove and lower than the surface of the main body portion. The container main body portion includes reinforcing lateral ribs each having a concave portion which is positioned at the same level as a surface of the container, which or forms a slight step relative to the surface of the container. The main body portion has a plurality of ridges converging toward the associated central convergent point, respectively, thereby defining multi-faceted concave walls inclined toward the associated convergent points, respectively.

12 Claims, 10 Drawing Sheets

U.S. PATENT DOCUMENTS

| | | | | |
|---|---|---|---|---|
| 2001/0037992 | A1 * | 11/2001 | Tanabe et al. | 215/384 |
| 2001/0054597 | A1 * | 12/2001 | Ozawa et al. | 215/381 |

FOREIGN PATENT DOCUMENTS

| | | | |
|---|---|---|---|
| JP | A 61-049826 | | 3/1986 |
| JP | U 03-015319 | | 2/1991 |
| JP | A 08-230857 | | 9/1996 |
| JP | 2736883 | B | 1/1998 |
| JP | A 10-029615 | | 2/1998 |
| JP | A 10-218148 | | 8/1998 |
| JP | A 10-305823 | | 11/1998 |
| JP | 11-301630 | A | 11/1999 |
| JP | 2000281032 | A * | 10/2000 |
| JP | A 2001-039422 | | 2/2001 |

* cited by examiner

SYNTHETIC RESIN CONTAINER HAVING IMPROVED SHAPE STABILITY

BACKGROUND ART

1. Technical Field

The present invention relates to a thin-walled synthetic resin container, and intends to provide a thin-walled synthetic resin container capable of effectively avoiding lowering of the rigidity of the container, which tends to be caused by its thin-walled nature, to thereby exhibit a required shape stability of the container.

2. Related Art

Synthetic resin containers, such as PET bottles made of polyethylene terephthalate resin, have been widely used as containers, e.g., for filling therein foods, beverages, cosmetics or medicines since such containers are light in weight and can thus be easily handled, have transparency to exhibit a refined appearance comparable to glass containers, and can be produced at low cost.

This type of synthetic resin container has a relatively low mechanical strength against external forces. Therefore, when the container is gripped at its main body portion for pouring the content out of the container, the container inevitably undergoes deformation at its gripped portion. It is thus a typical countermeasure to appropriately control the container wall thickness and form reinforcing means, e.g., longitudinal ribs, lateral ribs or waists (i.e., circumferential grooves surrounding the main body portion), for improving the resistances of the container to external forces, such as buckling strength and rigidity.

Furthermore, there is an increasing demand for thin-walled (or light-weighted) containers so as to reduce the resin amount to be used per one container from a standpoint of effective utilization of resources and reduction in the amount of wastes, resulting in a situation where the rigidity of the container is inevitably further lowered to deal with such a demand. In this instance, particularly in the case of a container having a polygonal cross-section and formed with a waist, the container tends to be deformed in its cross-section into rhombic shape due to the thin-walled nature of the entire container, when external force is applied to the waist portion in a diagonal direction at the corner of the waist portion. From such a viewpoint, in connection with a waist-formed synthetic resin container, there is a strong demand for a container structure having higher buckling strength and rigidity, and capable of minimizing deformation in terms of its outer shape of the container even when it is made thin-walled.

Meanwhile, synthetic resin containers have a relatively low thermal strength, and particularly, containers made of PET resin (polyethylene terephthalate resin) have a limitation on the filling temperature of contents, which must be not higher than approximately 85 to 87° C. Thus, when the contents at temperatures exceeding such a temperature range is filled into the containers, the containers are inevitably deformed due to heat shrinkage thereof. In this respect, there is known a technology as disclosed in JP 7-67732 B2, for example, for improving the heat resistance of containers by carrying out at least two times of biaxial-stretching blow molding before and after an intermediate heat treatment step, and there is indeed a tendency to raise the allowable filling temperatures of contents.

However, when this type of targeted container is thin-walled (or light-weighted) so as to reduce the used resin amount (for example, when the used resin amount is reduced from approximately 69 grams to 55 grams or less, in the case of a 2-liter container), the lower region of the container main body portion tends to bulge outwardly due to the self-weight (i.e., hydraulic head) of the contents and due to the affection of heat of the contents, thereby making it difficult to retain the initial shape of the container. Such bulging is particularly marked in containers having pressure-reduction absorbing panels, which serve to compensate for the shape deformation of the container due to pressure reduction within the container.

Although it is effective to form lateral ribs on a container main body portion so as to retain the outer shape of the container, the ribs may warp due to affection of heat because the container is thin-walled, thereby failing to effectively exhibit the reinforcing function of the ribs. From such a viewpoint, in connection with a synthetic resin container having an improved heat resistance allowing a hot filling of the contents at a relatively high temperature, there is a strong demand for a container structure having an excellent shape stability capable of retaining the initial shape of the container regardless of its thin-walled structure.

DISCLOSURE OF THE INVENTION

It is therefore an object of the present invention to provide a synthetic resin container capable of solving the above-mentioned problems of the prior art and effectively avoiding lowering of the rigidity of the container regardless of its thin-walled nature, to thereby exhibit a required shape stability of the container.

According to a first aspect of the present invention, there is provided a synthetic resin container provided with at least one waist, which divides a main body portion of the container into upper and lower parts, wherein the waist comprises an annular groove surrounding the main body portion so as to be convex toward the interior of the container, and the annular groove is provided with reinforcing ribs each having a level higher than a groove bottom of the annular groove and lower than the surface of the main body portion.

Preferably, the main body portion of the container has a polygonal cross-section, and each of the reinforcing ribs is arranged in a region which extends beyond an associated one of corners of the polygonal cross-section.

Preferably, each of the reinforcing ribs has an arcuate shape at its outer periphery.

According to a second aspect of the present invention, there is provided a synthetic resin container obtained by biaxial-stretching blow molding, wherein the container has a main body portion provided with reinforcing lateral ribs each having a concave portion which is positioned at the same level as a surface of said container, or which forms a slight step relative to said surface of said container.

Preferably, the concave portions are formed at central regions of the lateral ribs, respectively.

Preferably, the lateral ribs are projected inwardly of the main body portion of the container. Each of the lateral ribs may have such a length that the opposite ends of the lateral rib are short of the associated pillars, respectively.

Preferably, the synthetic resin container according to the present invention is provided with pressure-reduction absorbing panels at the main body portion.

Preferably, the synthetic resin container according to the present invention is provided with longitudinal ribs projected inwardly of the main body portion. The longitudinal ribs may have concave portions around the longitudinal ribs themselves, respectively, wherein the concave portions are lower than a surface of the container main body portion.

Preferably, the synthetic resin container according to the present invention has a quadrilateral cross-section including at least four locations around the main body portion, in the form of pillars comprising longitudinally elongated concave or convex surfaces, respectively, extending along a main axis of the container.

According to a third aspect of the present invention, there is provided a synthetic resin container obtained by biaxial-stretching blow molding, wherein the synthetic resin container has a main body portion provided with a plurality of ridges converging toward the associated central convergent points, respectively, such that the ridges form multi-faceted concave walls inclined toward the associated convergent points, respectively.

Preferably, the multi-faceted concave walls define the pressure-reduction absorbing panels. Each of the pressure-reduction absorbing panels may exhibit a quadrilateral shape, and the associated ribs of the quadrilateral shape may start from four corners of the quadrilateral shape to converge at the associated central convergent point. Preferably, each of the central convergent points has a lateral groove oriented perpendicularly to a main axis of the container.

BRIEF DESCRIPTION OF THE DRAWINGS

The present invention will be described in further detail hereinafter, with reference to the preferred embodiments shown in the drawings.

BEST MODE FOR CARRYING OUT THE INVENTION

Figure 1:
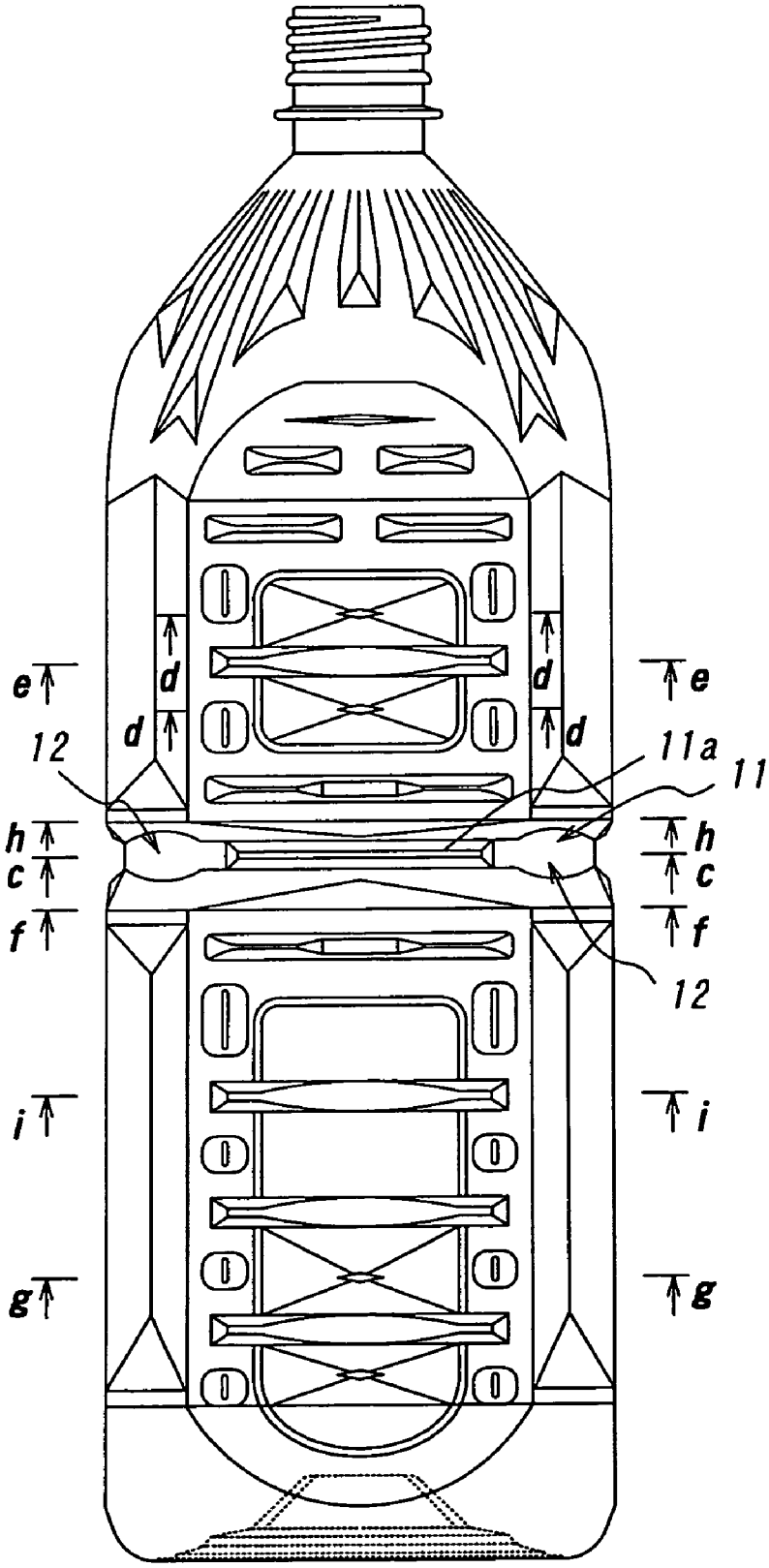
FIG. 1 is a front view of a waist-formed synthetic resin container according to a first embodiment of the present invention.
Figure 2:
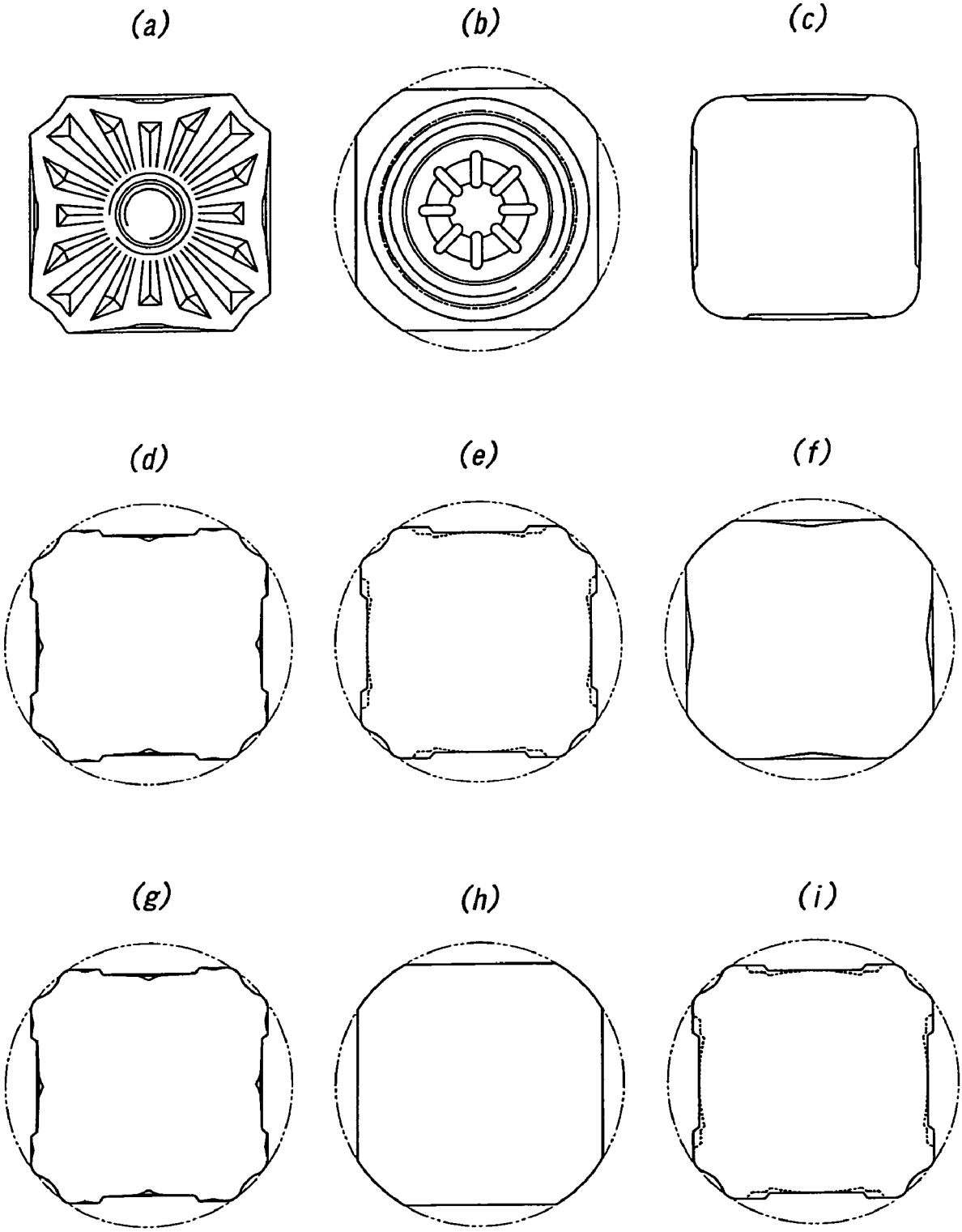
FIG. 2(*a*) and FIG. 2(*b*) are a plan view and a bottom view, respectively, of the container of FIG. 1, and FIGS. 2(*c*) through (*i*) are cross-sectional views taken along line c-c through line i-i of FIG. 1, respectively.

FIG. 1 through FIG. 4 show a synthetic resin container according to a first embodiment of the present invention. This container has a filling volume of 2.0 liters and is formed in a substantially quadrilateral cross-sectional shape. Reference numeral 11 denotes a waist which divides a main body portion of the container into upper and lower parts. This waist 11 comprises an annular groove 11*a* surrounding the main body portion in a manner to become convex toward the interior of the container.

Reference numerals 12 denotes reinforcing ribs, respectively, each having has a level higher than a groove bottom of the annular groove 11*a* and lower than the surface of the main body portion. Each reinforcing rib is formed into an arcuate shape at its outer periphery. These reinforcing ribs 12 are provided at four corners of the main body portion of the container in the present embodiment, respectively.

Although the waist formed by simply recessing the container main body portion and thereby dividing the main body portion into upper and lower parts is provided for the purpose of improving the rigidity of the container, the thin-walled container has a reduced strength at that region and thus tends to buckle when applied with a load from the upper or bottom portion of the container, besides that the thin-walled container is easily depressed when gripped at the waist portion.

Figure 3:
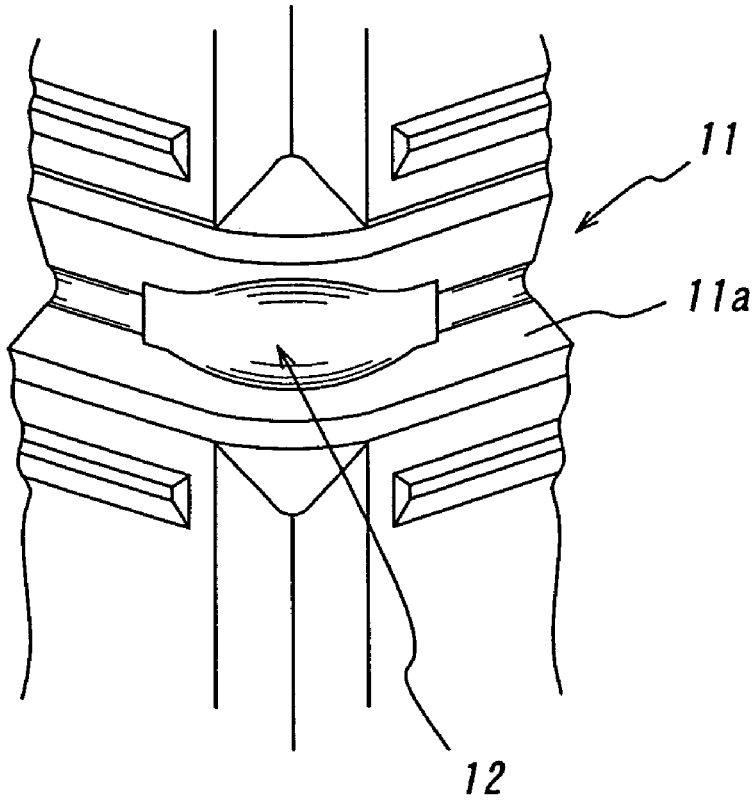
FIG. 3 is a front view of the reinforcing rib in the container of FIG. 1.

FIG. 3 is a front view of the reinforcing rib 12 shown in FIG. 1. When such a reinforcing rib 12 is provided at the waist 11, the reinforcing rib 12 functions as a frame of the container, thereby resulting in an extremely restricted deformation of the container main body portion upon gripping the same, and also resulting in a remarkably improved buckling strength of the container.

Figure 4:
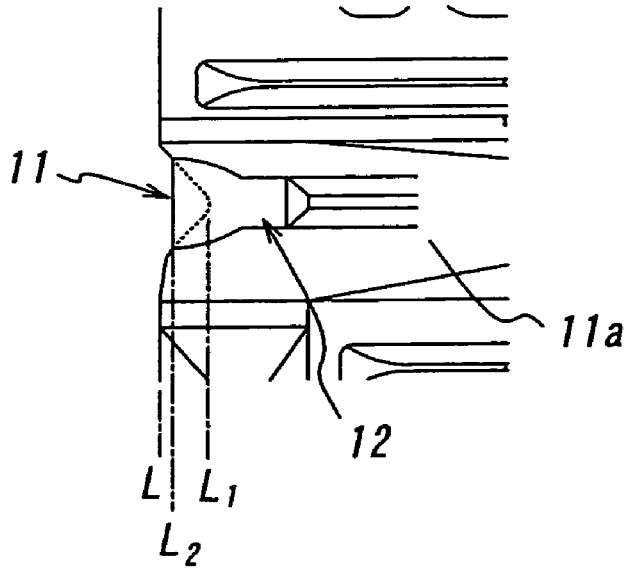
FIG. 4 is an enlarged view of the essential portion of the container shown in FIG. 1.

Each reinforcing rib 12 is preferably formed into a single arc, so as to avoid stress concentrations and stabilize the outer shape of the container. As can be appreciated from FIG. 4 showing the essential portion of the outer periphery of the reinforcing rib 12 in enlarged scale, the reinforcing rib 12 has a level $L_2$ lower than the surface level L of the container main body portion and higher than the groove bottom level $L_1$ of the annular groove 11*a*, so as to effectively exhibit the function of the reinforcing rib 12. Furthermore, the width of the reinforcing rib 12 in the circumferential direction (i.e., around the main body portion) is such that each end portion of the rib extends beyond the associated corner portion of the container and reaches the waist portion positioned at the walled surface of the container.

Although the above embodiment has been described in connection with a structure wherein the reinforcing ribs 2 are provided for the container having a quadrilateral cross-sectional shape, the present invention is not limited to the illustrated cross-sectional shape. Namely, the present invention is also applicable to containers having a polygonal cross-section, such as rectangular, pentagonal or hexagonal cross-section, as well as to containers having a circular cross-section. The present invention is also applicable to containers having a filling volume of not more than 500 milliliters, 1.0 liter, 1.5 liter and even to large-sized containers having a filling volume exceeding 2.0 liters, in addition to the illustrated container of 2.0 liter. There is no particular limitation in terms of the filling volume.

It is possible to use a thermoplastic resin such as a polyethylene terephthalate resin as the resin material for the container, and to produce the container by blow molding a preform obtained by extrusion molding or injection molding of such a resin.

The container produced by blow molding can be used for either normal temperature filling or high temperature filling of the contents. Particularly, in the case of containers to be filled with a high temperature liquid as the contents, it is possible to utilize a normal molding method for completing the container by performing one time of biaxial-stretching blow molding, and another molding method for completing the container having an improved heat resistance by performing at least twice of biaxial-stretching blow molding before and after an intermediate heat treatment step. Then, any of such containers are allowed to have an improved strength by providing reinforcing ribs 12 at the waist, if such waist is provided at the container main body portion.

According to the embodiment described above with reference to FIG. 1 through FIG. 4, the waist 11 is constituted of the annular groove 11*a* surrounding the container main body portion so as to be convex toward the interior of the container, and the reinforcing ribs 12 are provided such that each reinforcing rib 12 has a level higher than the groove bottom of the annular groove 11*a* and lower than the surface of the main body portion and each reinforcing rib is formed into an arcuate shape at its outer periphery. It is therefore possible to minimize the deformation of the container upon gripping the waist portion, and to remarkably improve the buckling strength and rigidity of the container even when the container is thin-walled.

Figure 5:
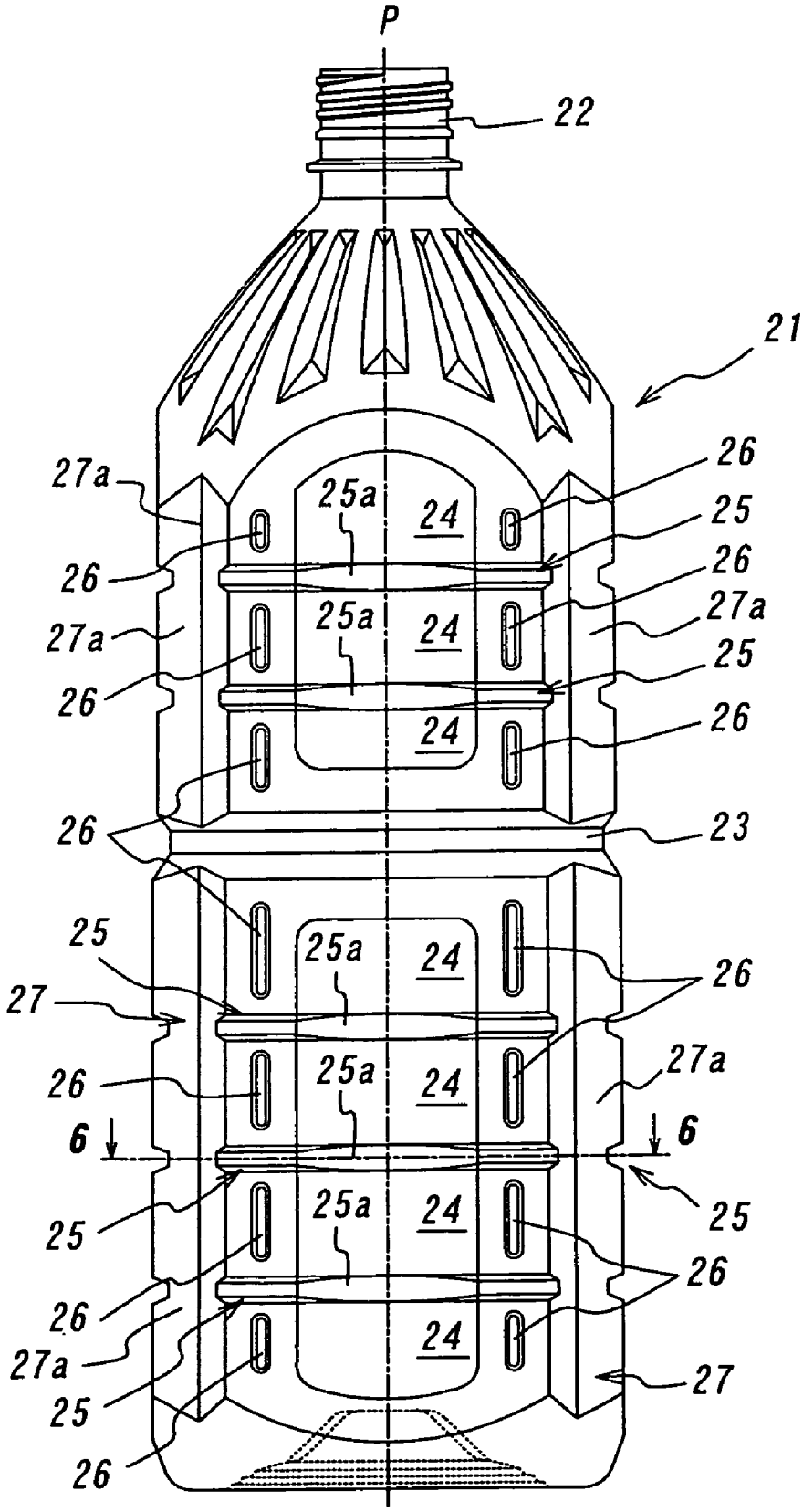
FIG. 5 is a front view of a synthetic resin container according to a second embodiment of the present invention.
Figure 6:
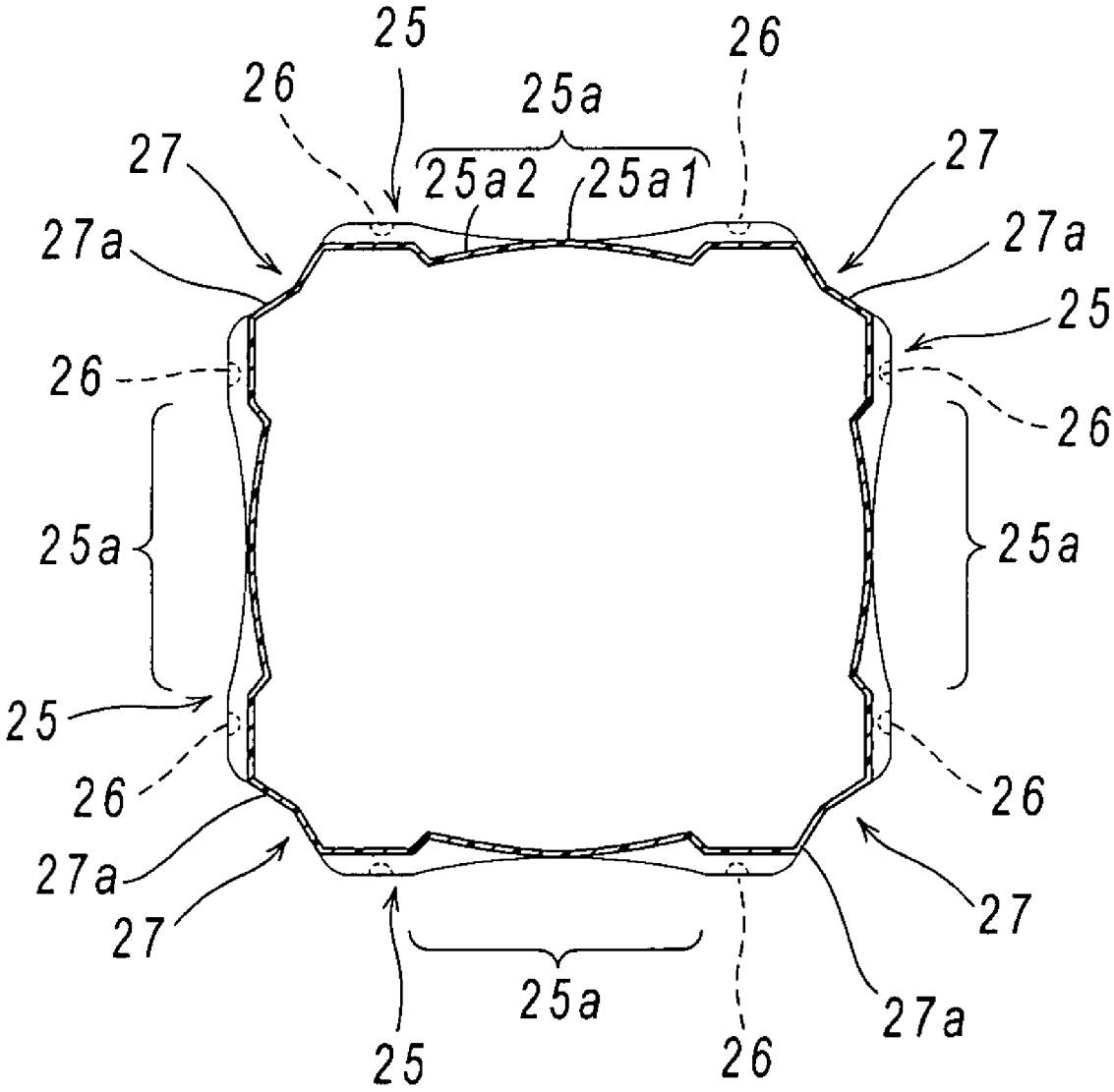
FIG. 6 is a cross-sectional view taken along line 6-6 of FIG. 5.

FIG. 5 and FIG. 6 show a synthetic resin container according to a second embodiment of the present invention. Reference numeral 21 denotes a container body, and reference numeral 22 denotes a mouth portion integral with the container body 21. Furthermore, reference numeral 23 denotes a groove portion for dividing the container body 21 into upper and lower parts to thereby enhance the rigidity of the container, and reference numerals 24 denotes pressure-reduction absorbing panels, respectively. Each pressure-reduction absorbing panel 24 has a function for preventing a shape deformation of the container due to a volume change thereof as a result of cooling of the contents therein.

Reference numeral 25 denotes reinforcing lateral ribs formed at the main body portion of the container so as to extend across the pressure-reduction absorbing panels 24, respectively. Each lateral rib 25 has a concave portion 25*a* at a central region (i.e., the central region in the longitudinal direction) of the lateral rib itself, such that the concave portion is flush at a position 25*a*1 with a surface of the container main body and forms a slight step relative to the surface of the container main body portion at a position 25*a*2.

Reference numerals 26 denotes reinforcing longitudinal ribs alternately arranged between the lateral ribs 25, respectively, and reference numerals 27 denotes pillars formed at four locations around the main body portion. Each pillar 27 has a longitudinally elongated concave surface 27*a* formed into a polygonal line shape and extended along a main axis P of the container.

There is known a synthetic resin container formed by one time of biaxial-stretching blow molding, or another synthetic resin container formed by at least two times of biaxial-stretching blow molding before and after an intermediate heat treatment step, such as that disclosed in JP-7-67732 B2. In this type of container, the residual stress in the container main body portion is remarkably mitigated and the strength against external heat is enhanced by virtue of the increased density of the resin. However, even if lateral ribs are provided to ensure the shape stability of this type of container when the container is thin-walled to reduce the resin amount to be used per one container, the lateral ribs inevitably tend to warp due to the self-weight (hydraulic head) of the contents themselves and due to the affection of the heat possessed by the contents. In such instance, the lateral ribs do not restore due to the plastic deformation of the lateral ribs themselves even after cooling of the contents, thereby resulting in a poor appearance of the container. According to the embodiment of FIG. 5 and FIG. 6, however, each concave portion 25*a* provided at the associated lateral rib 25 is flush at the position 25*a*1 with the surface of the container and forms a slight step relative to the surface of the container at position 25*a*2, so as to prevent warpage of the lateral rib 25 as a whole and thereby retain the initial shape of the container. Further, the lateral rib 25 effectively exhibited the intended function to keep the container in a highly rigid state. It is preferred for the lateral ribs 25 to be arranged along the widthwise direction of the pressure-reduction absorbing panels 24, respectively, so as to extend across these panels.

Although each lateral rib 25 has been exemplarily shown in FIG. 5 to have such a length that the opposite ends of the lateral rib reach the associated pillars 27, respectively, the length of the lateral rib may be preferably short of the pillars 27 so as not to affect the function of the pillars 27. Further, each pillar 27 is preferably constituted to have the concave surface 27*a* formed into the polygonal line shape or a convex surface 27*a* in an R shape, such that the pillar 27 does not easily buckle even upon application of a load from the upper or lower portion of the container.

The longitudinal ribs 26 may be arranged between the lateral ribs 25 and adjacent to the pillars 27, respectively. Provision of such longitudinal ribs 26 ensures that, even when the container is to be deformed due to a load upon gripping the container, the deformation of the container always occurs at constant locations i.e., in the directions of the end portions of lateral ribs 25, in the present embodiment, so that the container is immediately restored to its initial shape upon releasing of the load that caused the deformation. This means that it is possible to improve the restoring performance of the container after deformation.

Figure 7:
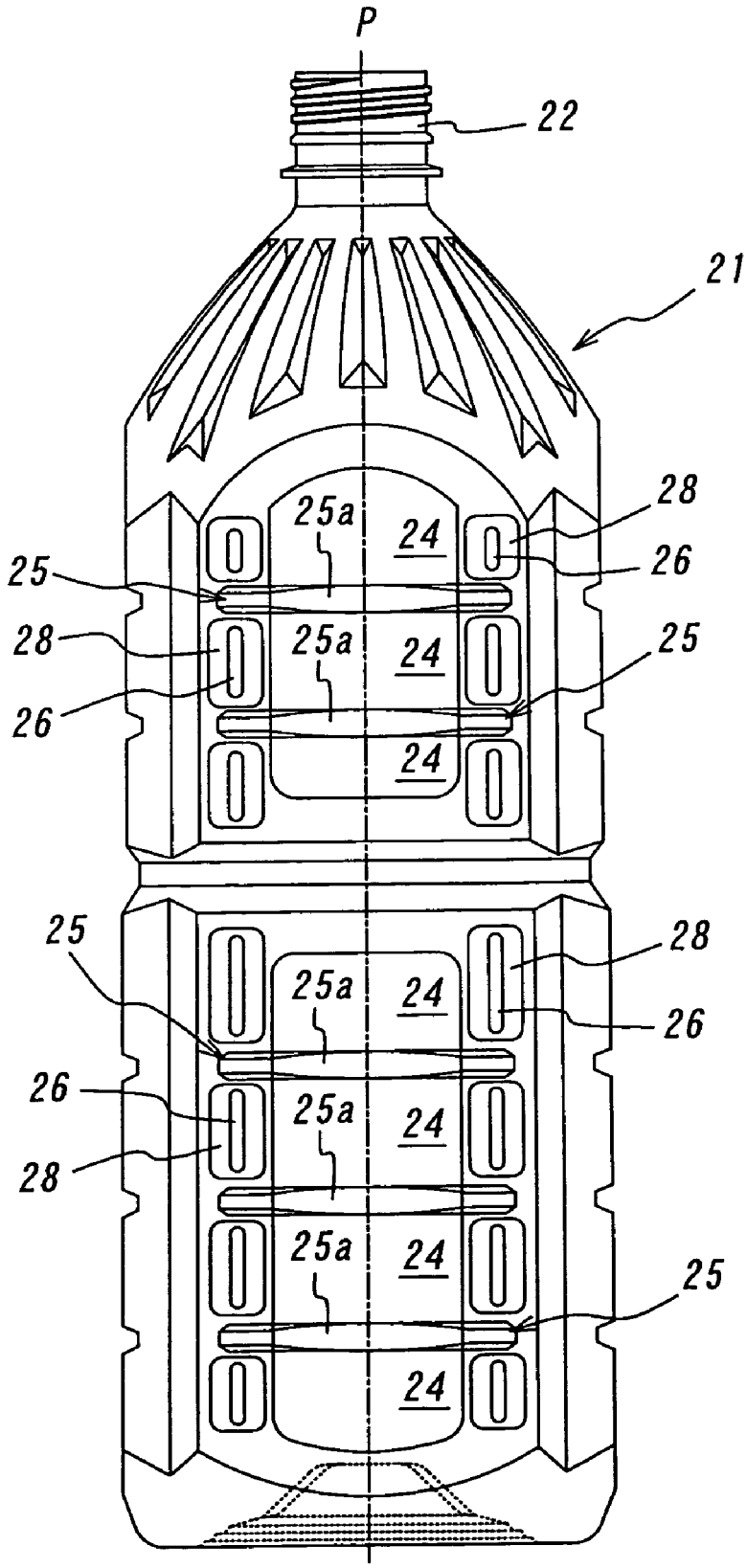
FIG. 7 is a front view of a synthetic resin container according to a third embodiment of the present invention.

FIG. 7 shows a synthetic resin container according to a third embodiment of the present invention. In this embodiment, the region around each longitudinal rib 26 is formed as a concave portion 28 which is lower than surface of the container main body portion such that the contour shape of the longitudinal rib 26 is embossed upon molding the container to thereby further enhance the reinforcing effect near the corner portion of the container, while each lateral rib 25 is made to have a reduced length such that the opposite ends thereof are short of the associated pillars 27, respectively. Such a constitution ensures that the buckling strength is further enhanced in the container having a quadrilateral cross-section, and the restoring ability of the container after deformation is further improved.

When containers are produced by adopting a polyethylene terephthalate resin as the resin for the container and conducting two times of biaxial-stretching blow molding before and after an intermediate of heat treatment step, the following procedure shall be followed.

First of all, a preform obtained by extrusion molding or injection molding is heated to a temperature which allows exhibition of stretching effect, e.g., to a temperature range of 70 to 130° C., and more preferably 90 to 120° C. Then, the first time of biaxial-stretching blow molding is conducted under a temperature condition of 50 to 230° C., more preferably 70 to 180° C., with a surface stretching ratio of 4 to 22 (more preferably 6 to 15, into an oversized intermediate body having a volume which is about 1.2 to 2.5 times that of the finished container). Next, the thus obtained blow molded body is applied with a forced heat treatment at a temperature in a range of 110 to 255° C., more preferably 130 to 200° C., so as to be shrunk to a size which is about 0.60 to 0.95 times that of the finished container, to thereby remove the residual stress in the article. Subsequently, there is conducted a second time of biaxial-stretching blow molding at a temperature in a range of 60 to 170° C., more preferably 80 to 150° C. It is noted that the container according to the present invention may be of course molded by one time of biaxial-stretching blow molding, without following the above conditions.

In this way, according to the embodiment shown in FIG. 5 and FIG. 6 or the embodiment shown in FIG. 7, the resin container having an improved heat resistance is provided with the reinforcing lateral ribs 27 having the concave portions 27*a*, respectively, each of which is positioned at the same level as the surface of the container or forms a slight step relative to the surface of the container, thereby making it possible to maintain an improved shape stability even when the container is thin-walled for reducing the used amount of resin.

Figure 8:
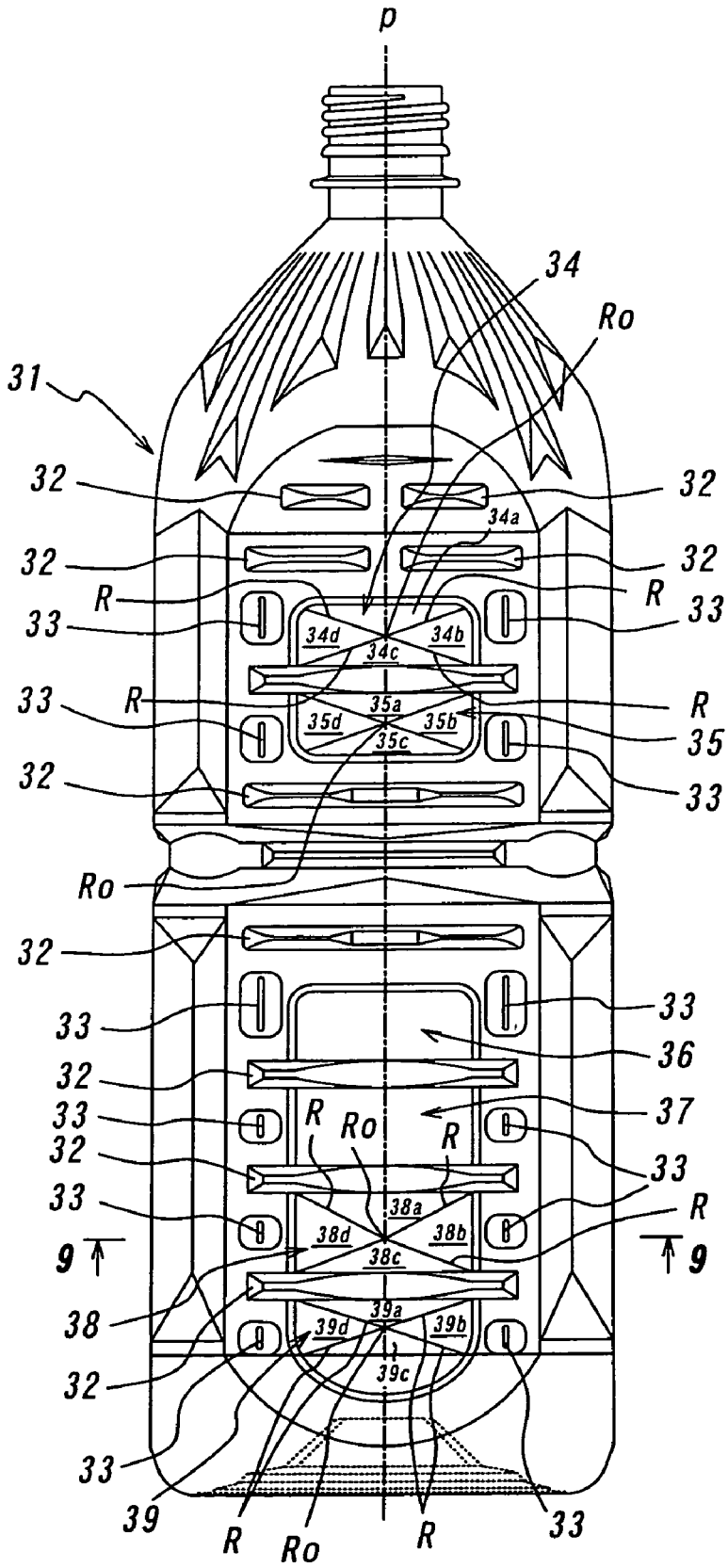
FIG. 8 is a front view of a synthetic resin container according to a fourth embodiment of the present invention.
Figure 9:
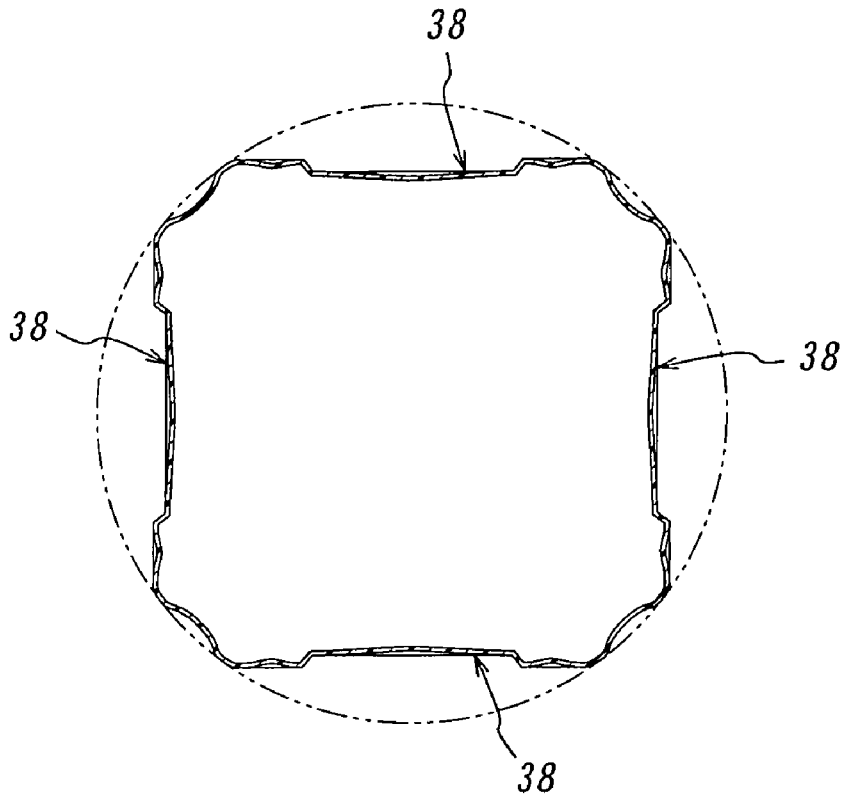
FIG. 9 is a cross-sectional view taken along line 9-9 of FIG. 8.
Figure 10:
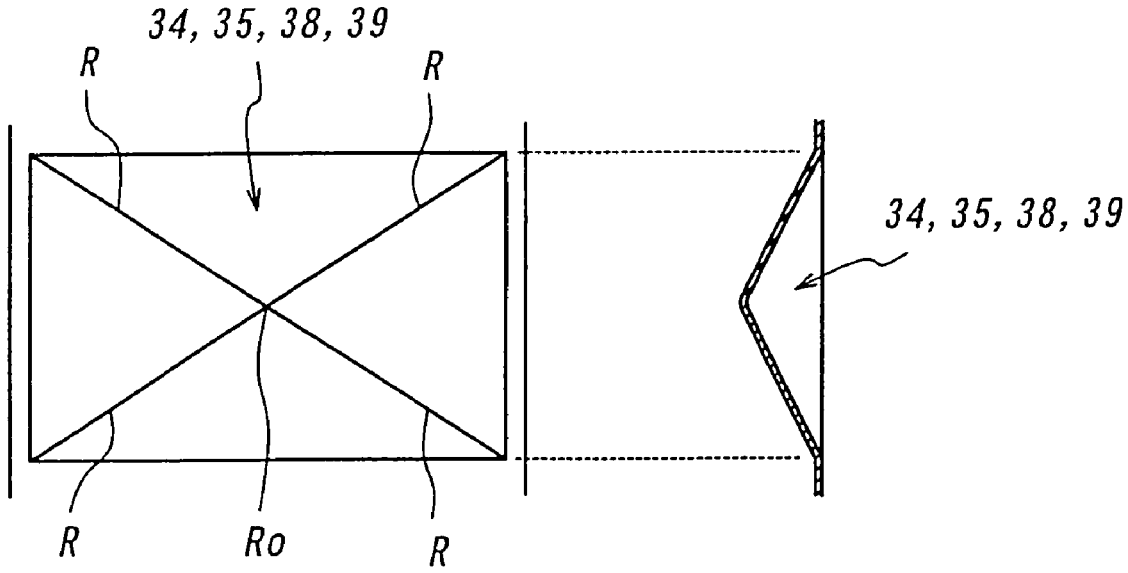
FIG. 10 is a view showing an essential portion of the pressure-reduction absorbing panel.

FIG. 8 through FIG. 10 show a synthetic resin container according to a third embodiment of the present invention. Reference numeral 31 denotes a container body, reference numerals 32 denotes reinforcing lateral ribs, respectively, appropriately formed at the main body portion of the container body 31, reference numerals 33 denotes reinforcing longitudinal ribs, respectively, appropriately formed at the main body portion of the container body 31, and reference numerals 34 through 39 denote pressure-reduction absorbing panels, respectively, shown as being linearly arranged on the main body portion of the container body 31 by way of example.

While the panels 36, 37 among the pressure-reduction absorbing panels 34 through 39 are shown as having flat surfaces, respectively, each of the remaining panels 34, 35, 38, 39 is provided with ridges R (inwardly convexed ridges) converging at a central convergent point of the applicable panel so that the ribs R define a multi-faceted concave wall comprising wall surfaces 34*a* through 34*d*, 35*a* through 35*d*, 38*a* through 38*d* or 39*a* through 39*d*, which are inclined toward the associated convergent point Ro. The details of the panels 34, 35, 38, 39 are shown in FIG. 10.

By forming the pressure-reduction absorbing panels 34, 35, 38, 39 into the multi-faceted concave walls according to the embodiment of FIG. 8 through FIG. 10, respectively, it is possible for the ridges R to act as reinforcing frames of the panels, respectively, thereby advantageously avoiding bulging of the container due to the hydraulic head of the contents. Further, since the shape deformation of the container due to the pressure reduction is compensated for by the entirety of each pressure-reduction absorbing panels 34, 35, 38, 39, this function is not affected by the associated ridges R.

Although the pressure-reduction absorbing panels 36, 37 are embodied to have flat surfaces in the embodiment of FIG. 8, such an arrangement is to stabilize the shape of the container, and it is possible in the present invention to constitute the container by appropriately combining panels having flat surfaces, with panels having multi-faceted concave walls.

Figure 11:
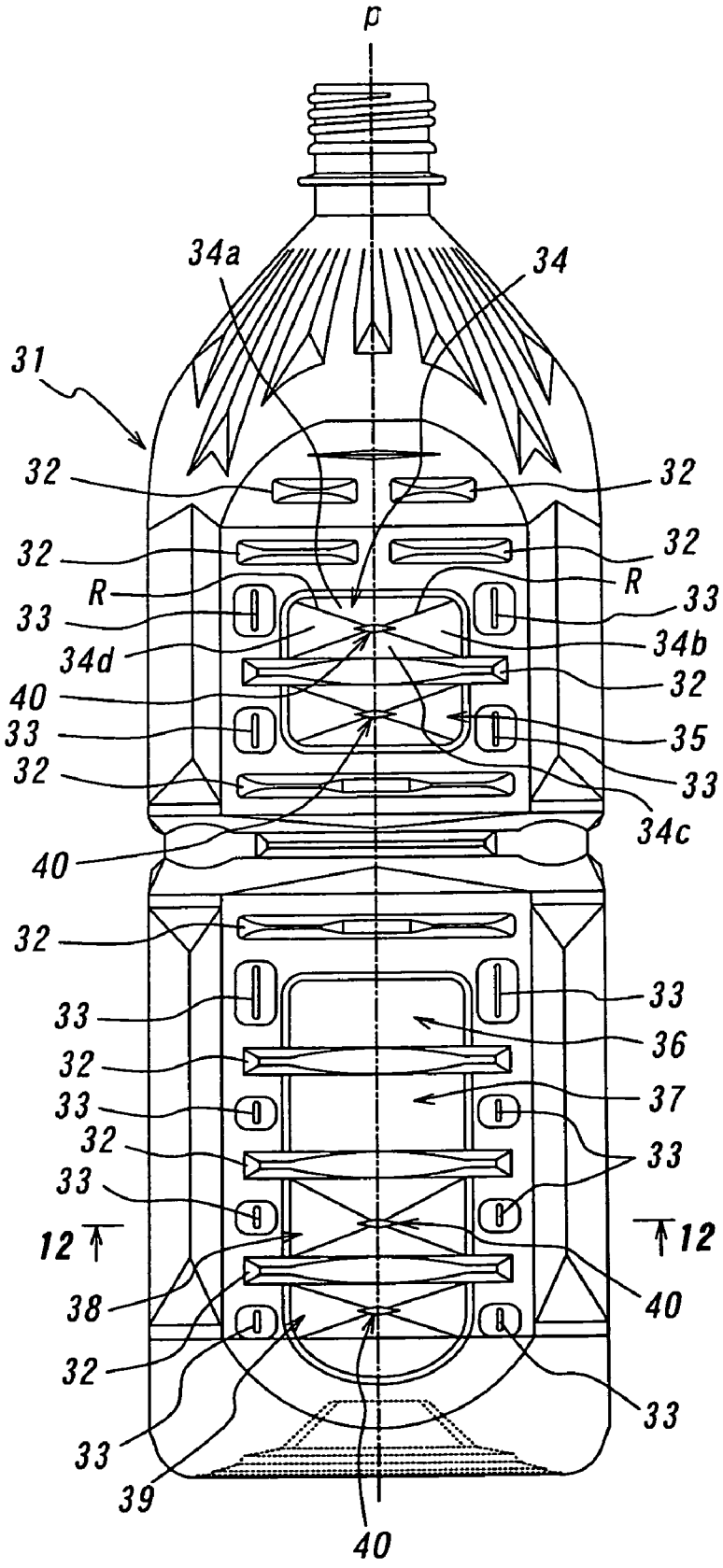
FIG. 11 is a front view of a synthetic resin container according to a fifth embodiment of the present invention.
Figure 12:
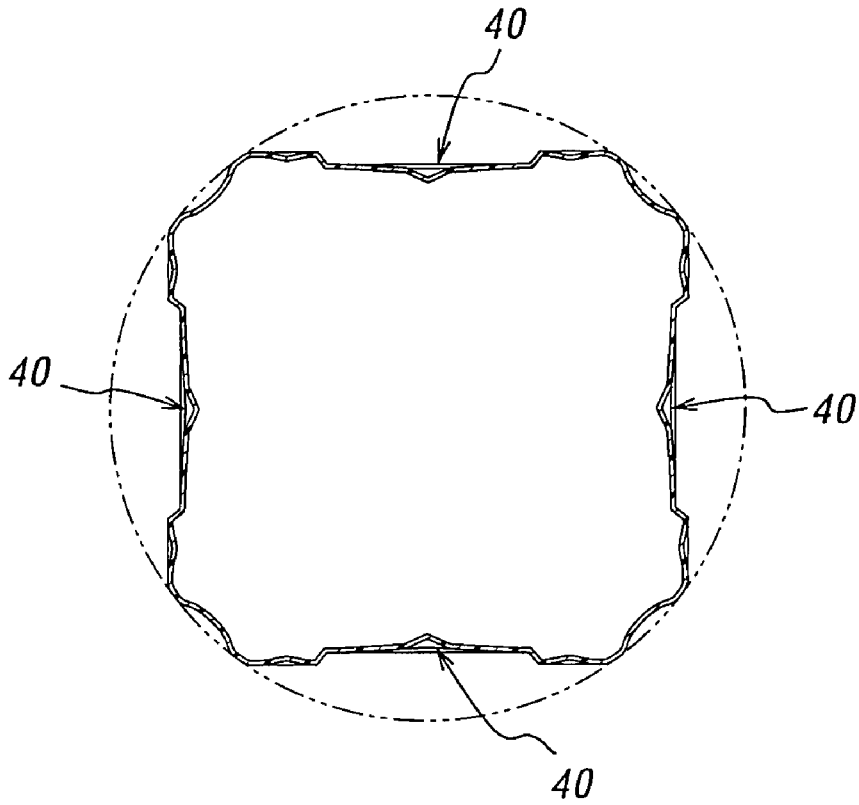
FIG. 12 is a cross-sectional view taken along line 12-12 of FIG. 11.
Figure 13:
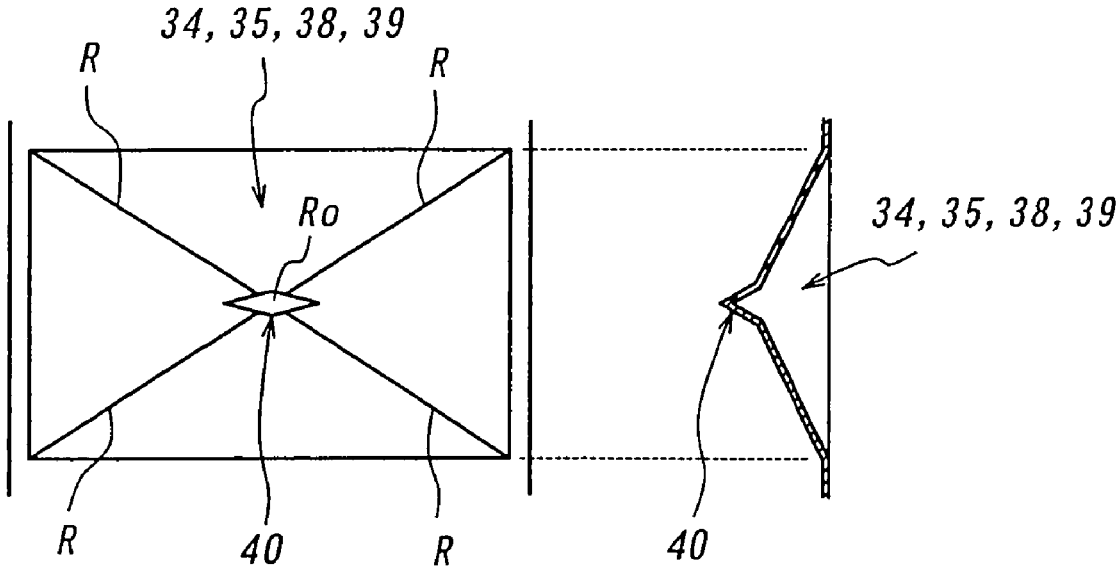
FIG. 13 is an enlarged view of the pressure-reduction absorbing panel in the container of FIG. 11.

FIG. 11 through FIG. 13 show a synthetic resin container according to a fourth embodiment of the present invention. This embodiment is achieved when the convergent point $R_0$ of each of the pressure-reduction absorbing panels 34, 35, 38, 39 in the embodiment of FIG. 8 through FIG. 10 is provided with a lateral groove 40 oriented perpendicularly to the main axis P of the container. The provision of such lateral grooves 40 allows a further suppression of bulging of the pressure-reduction absorbing panels 34, 35, 38, 39 due to the hydraulic head of the contents.

Although the embodiment shown in FIG. 11 through FIG. 13 has been described with reference to an arrangement wherein the multi-faceted concave walls are applied to the pressure-reduction absorbing panels 34, 35, 38, 39 having a reduced wall thickness, such multi-faceted concave walls can be directly provided at the main body portion of the container body 31, without limited to the application to the pressure-reduction absorbing panels only.

According to the embodiment of FIG. 11 through FIG. 13, the main body portion of the synthetic resin container is provided with multiple ridges converging toward the associated central convergent points, respectively, such that the ridges define multi-faceted concave walls that are inclined toward the associated convergent points, respectively. Therefore, it is possible to retain a high shape stability of a resin container having an excellent heat resistance, even when the container is thin-walled to reduce the used amount of resin.

It will be appreciated from the foregoing description that, according to the present invention, it is possible to solve various problems of the prior art and realize a thin-walled synthetic resin container capable of effectively avoiding lowering of the rigidity of the container due to its thin-walled nature, to thereby exhibit a required shape stability of the container.

It is needless to say that the present invention is not limited to the above-mentioned embodiments, and may be carried out with numerous variants.

The invention claimed is:

1. A synthetic resin container provided with at least one waist, which divides a main body portion of the container into upper and lower parts, wherein:

said main body portion has a polygonal cross-section including four corner portions around said main body portion, said corner portions being a pillar comprising a longitudinally elongated nonplanar surface extending along a main axis of said container, said waist comprises an annular groove surrounding said main body portion so as to be convex toward the interior of said container, said annular groove is provided with reinforcing ribs each having a level higher than a groove bottom of said annular groove and lower than a surface of said main body portion, and each of said reinforcing ribs is arranged at a corner portion of the main body portion, each reinforcing rib having a width in the circumferential direction such that each end portion of each rib extends beyond an associated corner of the polygonal cross-section and into neighboring side surfaces of the waist.

2. The synthetic resin container according to claim 1, wherein each of said reinforcing ribs extends between said neighboring side surfaces as a single arc, as seen in the polygonal cross-section.

3. The synthetic resin container according to claim 1, wherein each of said reinforcing ribs has an accurate shape at its outer periphery.

4. A synthetic resin container obtained by a biaxial-stretching blow molding, comprising:

a main body portion provided with reinforcing lateral ribs each having a concave portion which is flush at a first position with a surface of said container, and forms a slight step relative to said surface of said container at a second position, wherein:

said main body portion has a quadrilateral cross-section including at least four locations around said main body portion, each location being a pillar comprising longitudinally elongated nonplanar surfaces, respectively, extending along a main axis of said container, each of said lateral ribs has a length such that the opposite ends of the lateral rib are short of the associated pillars, respectively, and said main body portion is provided with longitudinal ribs located between said lateral ribs and adjacent to said pillars.

5. The synthetic resin container according to claim 4, wherein said concave portions are formed at central regions of said lateral ribs, respectively.

6. The synthetic resin container according to claim 4, wherein said lateral ribs are projected inwardly of said main body portion of said container.

7. The synthetic resin container of claim 4, wherein said synthetic resin container is provided with pressure-reduction absorbing panels at said main body portion.

8. The synthetic resin container according to claim 4, wherein said longitudinal ribs projected inwardly of said main body portion.

9. The synthetic resin container according to claim 8, wherein said longitudinal ribs have concave portions around said longitudinal ribs themselves, respectively, and said concave portions are lower than a surface of said main body portion of said container.

10. A synthetic resin container obtained by biaxial-stretching blow molding, comprising:

a main body portion provided with a plurality of ridges converging toward associated central convergent points, respectively, such that said ridges form multi-faceted concave walls inclined toward the associated convergent points, respectively, the main body portion provided with a plurality of longitudinal ribs, wherein each of said central convergent points has a lateral groove oriented perpendicularly to a main axis of said container.

11. The synthetic resin container according to claim 10, wherein said multi-faceted concave walls define a pressure-reduction absorbing panel.

12. The synthetic resin container according to claim 11, wherein said pressure-reduction absorbing panel exhibits a quadrilateral shape, and the associated ridges of said quadrilateral shape start from four corners of said quadrilateral shape to converge at the associated central convergent point.

* * * * *